US007744814B2

(12) United States Patent
Meng et al.

(10) Patent No.: US 7,744,814 B2
(45) Date of Patent: Jun. 29, 2010

(54) METHOD FOR PRODUCING A MAGNESIUM-LANTHANUM PRASEODYMIUM CERIUM INTERMEDIATE ALLOY

(75) Inventors: Jian Meng, Changchun (CN); Daqing Fang, Changchun (CN); Deping Zhang, Changchun (CN); Jiacheng Shen, Changchun (CN); Dingxiang Tang, Changchun (CN); Hongjie Zhang, Changchun (CN)

(73) Assignee: Changchun Institute of Applied Chemistry Chinese Academy of Sciences, Changchun, Jilin Province (CN)

( * ) Notice: Subject to any disclaimer, the term of this patent is extended or adjusted under 35 U.S.C. 154(b) by 0 days.

(21) Appl. No.: 12/343,414

(22) Filed: Dec. 23, 2008

(65) Prior Publication Data

US 2009/0166216 A1 Jul. 2, 2009

(30) Foreign Application Priority Data

Dec. 27, 2007 (CN) ..... 2007 1 0300339

(51) Int. Cl.
*C25C 1/24* (2006.01)

(52) U.S. Cl. ..... 420/405

(58) Field of Classification Search ..... None
See application file for complete search history.

(56) References Cited

U.S. PATENT DOCUMENTS 3,383,294 A * 5/1968 Wood ..... 205/368
5,932,084 A * 8/1999 Takamaru ..... 205/368
7,473,343 B2 * 1/2009 Sakamoto et al. ..... 205/181

* cited by examiner

*Primary Examiner*—Roy King
*Assistant Examiner*—Yoshitoshi Takeuchi
(74) *Attorney, Agent, or Firm*—Greenberg Traurig, LLP

(57) ABSTRACT

Methods for producing a magnesium-rare earth intermediate alloy, which belongs to the technical field of molten salt electrolytic metallurgical technology. In one embodiment, the method comprises subjecting magnesium chloride, lanthanum praseodymium cerium chloride and potassium chloride to an electrolysis, and adding additional lanthanum praseodymium cerium chloride and magnesium chloride during the electrolysis. In the electrolysis process, neither metal magnesium nor rare earth metal is used, only the chlorides of rare earths and magnesium are used and the rare earth ions and the magnesium ions are co-electrodeposited on the cathode, so as to obtain the intermediate alloy having a melting point close to the eutectic temperature of the rare earth and magnesium. The method has various advantages including but not limited to high operability, simple process and equipment, stable quality of product by mass production and easy for commercial scale production.

3 Claims, No Drawings

METHOD FOR PRODUCING A MAGNESIUM-LANTHANUM PRASEODYMIUM CERIUM INTERMEDIATE ALLOY

RELATED APPLICATION

This application claims the benefit of and priority to Chinese Application No. 200710300339.3, filed Dec. 27, 2007, the content of which is incorporated by reference herein in its entirety.

BACKGROUND

1. Technical Field

The invention relates to a method for producing a magnesium-rare earth intermediate alloy, which belongs to the technical field of molten salt electrolytic metallurgical technology.

2. Background of the Art

Magnesium-rare earth intermediate alloy is a basic material for producing an advanced and new type of corrosion-resistant and high temperature-resistant magnesium alloy. There are mainly the following three methods for producing a magnesium-rare earth intermediate alloy. The first one is mutual infiltration method, and the second one is magnesium thermal reduction method, but these two methods have the following defects: it is difficult for the mutual infiltration method to avoid segregation of the alloy components, since magnesium is greatly different from most of rare earth metals in specific gravity and melting point, so that rare earth metals cannot be dispersed well into magnesium; while the magnesium thermal reduction method is a batch method, which production cost is high. The third one is molten salt electrolytic method, which comprised both of liquid state cathode method and co-precipitation electrolytic method.

Liquid state cathode method is a method for producing a magnesium-rare earth intermediate alloy by electrolysis using magnesium or magnesium-rare earth intermediate alloy having a low rare earth content as liquid state cathode. Electrolysis is carried out by using the alloy constituents as the cathode, wherein rare earth ions in the electrolyte is migrated and dispersed toward the cathode under the action of DC electric field, and an electrochemical reaction is carried out on the cathode. The rare earth segregated on the cathode is alloyed with the cathode magnesium to produce the magnesium-rare earth intermediate alloy having a low melting point.

Ping LI, Dingxiang TANG, et al. proposed a method for producing an yttrium-rich rare earth-magnesium alloy having 20 to 30% of yttrium-rich rare earth, by using an alloy having 10 wt % of yttrium-rich rare earth as a sinking cathode, in a electrolyte of 15 to 20% of $RE(Y)Cl_3$—KCl—NaCl, under an electrolysis condition of a cathode current density being 1 to 1.5 A/cm$^2$, with a current efficiency of greater than 70%[1].

Chunxu REN and Kangning ZHANG proposed a method for electrolyzing neodymium magnesium alloy using liquid state metal magnesium as a cathode. Magnesium is floated on the surface of the electrolyte because of its lower density, and becomes the upper liquid cathode. $NdCl_3$—KCl—NaCl is used as the electrolyte, the content of $NdCl_3$ is 20%. The electrolysis temperature is 820±20° C., and the cathode current density is 1.5 A/cm$^2$. At the early stage of electrolysis, the magnesium cathode is floated on the tope of the electrolyte. During the electrolysis, as neodymium is segregated continuously and formed into a magnesium neodymium alloy with the liquid state cathode, the density of the cathode alloy increases with the content of neodymium. When its density is greater than that of the electrolyte, the alloy cathode sinks into a bottom receiver. At this moment, the cathode conductive molybdenum bar should also fall down along with the alloy cathode so as to keep contact with the alloy. During the electrolysis, the alloy is stirred continuously, which can accelerate the dispersion of neodymium into the inside of the alloy, enhance the alloying process, eliminate the concentration gradient of the alloy, and increase the current efficiency and the direct yield of neodymium, wherein the neodymium content in the magnesium alloy can be up to about 30%. The current efficiency of the process is 65-70%, and the neodymium direct yield is up to 80-90%[2].

The co-precipitation electrolytic method is a method for producing a magnesium-rare earth intermediate alloy by using the co-precipitation of the rare earth ions and magnesium ion in the electrolyte onto the cathode.

Yttrium magnesium and yttrium magnesium-rich alloys were produced in Zhongshan University, by electrolytically coprecipitating in a melt containing yttrium chloride and yttrium-rich chloride, in a small type of graphite electrolysis cell. In the case where the temperature is 850 to 860° C., the cathode current density is 20 to 32 A/cm$^2$, and 25 to 35% of $YCl_3$ and 4 to 6% of $MgCl_2$ is contained in the melt, an yttrium magnesium alloy containing about 60% of yttrium can be obtained through electrolysis, wherein the average current efficiency is 70%, and the yttrium direct yield is 75%, with a maximum being able to be up to 83%.

A yttrium magnesium alloy having a yttrium amount of more than 60% is obtained in Hunan Rare Earth Material Institute, by using $YCl_3$—$MgCl_2$—KCl as the electrolyte, and electrolyzing at a temperature of 900° C., in a graphite electrolysis cell having a diameter of 150 mm, wherein the current efficiency is 50%, and the rare earth direct yield is greater than 70%[4].

In Baotou Rare Earth Research Institute, a Mg—Ce intermediate alloy containing 40 to 60% of Ce is produced under an order of 800 A, by using $CeCl_3$ crystalline material and anhydrous $MgCl_2$, with $CeCl_3$—$MgCl_2$—KCl in a ratio of $CeCl_3/MgCl_2/KCl$=25-35/3-5/60-70 (wt %) being the electrolyte, at a temperature of 900 to 920° C. and under a cathode current density of 10 to 15 A/cm$^2$, wherein the current efficiency is up to 75%, the direct yield of the rare earth is 95%, and the direct yield of magnesium is 98%[5].

However, the raw materials used is anhydrous rare earth metal chloride in the liquid state cathode method, and anhydrous magnesium chloride in the electrolytic co-precipitation method, which require a complicated dehydrating process, especially the process for removing the final 2 crystalline waters from magnesium chloride is extremely complicated, causing many problems such as large energy consumption, large material consumption and the equipment corrosion by HCl.

REFERENCE DOCUMENTS

[1] Ping LI, Jinzhi SUN, Dingxiang TANG, et al., the Production of Yttrium-Rich Rare Earth-Magnesium Alloy through a Sinking Cathode Molten Salt Electrolytic Method, Journal of the Chinese Society of Rare Earths, 1987, 5 (2):55-59;

[2] Chunxu REN and Kangning ZHANG, the Production of metal neodymium through magnesium cathode electrolysis-vacuum distillation method, Journal of the Chinese Society of Rare Earths, 1986, 4 (4): 73-76;

[3] Qiuxin YU, Qiqin YANG, Guankun LIU, the Study on the Coprecipitation of Yttrium Magnesium in a Chloride Melt, Rare Metal, 1986, 6: 35-38;

[4] Guangxian XU, Rare Earth (Middle Volume). Beijing: Metallurgical Industry Press, 2002, 189-190; and

[5] Yonghong REN, Zhihong ZHANG. The Scientific and Technical Progress of Rare Earth. Edited by the Chinese Rare Earth Society, 2000: 216-220.

DISCLOSURE OF THE INVENTION

An object of the invention is to provide a method for producing a magnesium-lanthanum praseodymium cerium intermediate alloy, in which the magnesium rare earth intermediate alloy is produced directly by using, as the raw material, compounds of rare earth and magnesium only, not magnesium and rare earth metal, and co-electrodepositing the ions of rare earth and magnesium on a cathode.

Specifically, the invention provides a method for producing a magnesium-lanthanum praseodymium cerium intermediate alloy, which steps and conditions are as follows:

the raw materials used are: lanthanum praseodymium cerium chloride, which is obtained by subjecting an on-sale crystalline material obtained after neodymium, cerium, and praseodymium have been extracted from common mixed light rare earths to a incomplete dehydrating treatment in a vacuum drying oven so as to have a water content of 10-15 wt %; and a magnesium chloride having 2 or less crystalline waters, which is obtained after removing 4 crystalline waters from $MgCl_2.6H_2O$ via a baking process, so as to have a water content of 20-27 wt %;

a graphite crucible is used as an anode, and a molybdenum bar is used as a cathode;

the magnesium chloride, the lanthanum praseodymium cerium chloride, and potassium chloride are added into the graphite crucible such that the mass ratio of the magnesium chloride:the lanthanum praseodymium cerium chloride:potassium chloride is 5:(40-35):(55-60);

electrolysis is performed under an electrolysis temperature of 800-900° C., a cathode current density of 10-30 A/cm$^2$, and a distance between the electrodes of 4 to 8 cm; and during the electrolysis, hydrous lanthanum praseodymium cerium chloride and magnesium chloride with a mass ratio of 1:(1.5-5) are added to replenish the consumption of the lanthanum praseodymium cerium chloride and the magnesium chloride, to obtain a magnesium-lanthanum praseodymium cerium intermediate alloy.

In the resultant magnesium-lanthanum praseodymium cerium intermediate alloy, the rare earth content is in a range of 40-65%, and the current efficiency is in a range of 65-85%. The direct yields of magnesium and rare earth are up to 88-95% and 85-93%, respectively.

The beneficial effect:

The magnesium-lanthanum praseodymium cerium rare earth intermediate alloy produced by the method according to the present invention is a basic raw material for producing a magnesium alloy in a corrosion-resistant and high-temperature resistant application. In the method according to the present invention, neither metal magnesium nor rare earth metal is used, only the chlorides of rare earths and magnesium are used, and the rare earth ions and the magnesium ions are co-electrodeposited on the cathode so as to produce an intermediate alloy having a melting point close to the eutectic temperature of the rare earth and magnesium. Hydrous chlorides of rare earth and magnesium are used during the electrolysis, thus the problem of high cost resulting from the complete dehydration of the raw material is overcome, the production cost is reduced, and the complicated process for removing the final 2 crystalline waters from the magnesium chloride is omitted, and problems such as large energy consumption, large material consumption and the equipment corrosion by HCl brought about therefrom are overcome. The method of the present invention has the advantages of high operability, simple process and equipment, stable quality of product by mass production, and easy for commercial scale production.

BEST MODE FOR CARRYING OUT THE INVENTION

Example 1

The raw materials used were: lanthanum praseodymium cerium chloride, which is obtained by subjecting an on-sale crystalline material obtained after neodymium, cerium, and praseodymium had been extracted from common mixed light rare earths (chloride of mixed rare earths, produced by Sichuan Liangyou Rare Earth Ltd., having a lanthanum praseodymium cerium content of 69.4%, and a crystalline water content of 30.6%), to a incomplete dehydrating treatment in a vacuum drying oven under conditions of 85° C., 3 hrs; 130° C., 2 hrs; and 180° C., 1 hr, wherein the lanthanum praseodymium cerium chloride after the incomplete dehydration had a water content of 12 wt %; and a magnesium chloride, which was obtained from $MgCl_2.6H_2O$ after being subjected to a baking process in a drying oven at 110° C. for 6 hrs to remove 4 crystalline waters, and which had a water content of 25 wt % after the baking process.

A graphite crucible was used as an anode, and a molybdenum bar was used as a cathode. An electrolyte (the total amount of the electrolyte being 8.5 kg) formulated with the magnesium chloride, the lanthanum praseodymium cerium chloride, and potassium chloride in a mass ratio of 5:35:60 was added into the graphite crucible. Electrolysis was performed under an electrolysis temperature of 800° C., a cathode current density of 30 A/cm$^2$, and a distance between the electrodes of 8 cm; and during the electrolysis, 160.14 g of lanthanum praseodymium cerium chloride and magnesium chloride having 2 crystalline waters with a mass ratio of 1:1.9 were added at an interval of 5 min. such that a total amount of 5605 g were added. After 3 hrs lapsed, the magnesium-lanthanum praseodymium cerium intermediate alloy was obtained, which weight was 1499 g. The rare earth content was 56.4%, the current efficiency was 65%, the rare earth direct yield was up to 88%, and the direct yield of magnesium was up to 94%.

Example 2

The raw materials used were: lanthanum praseodymium cerium chloride, which is obtained by subjecting an on-sale crystalline material obtained after neodymium, cerium, and praseodymium had been extracted from common mixed light rare earths (chloride of mixed rare earths, produced by Sichuan Liangyou Rare Earth Ltd., having a lanthanum praseodymium cerium content of 69.4%, and a crystalline water content of 30.6%), to a incomplete dehydrating treatment in a vacuum drying oven under conditions of 85° C., 3 hi's; 130° C., 2 hrs; and 180° C., 1.5 hrs, wherein the lanthanum praseodymium cerium chloride after the incomplete dehydration had a water content of 10 wt %; and a magnesium chloride, which was obtained from $MgCl_2.6H_2O$ after being subjected to a baking process in a drying oven at 110° C. for 6 hrs to remove 4 crystalline waters, and which had a water content of 27 wt % after the baking process.

A graphite crucible was used as an anode, and a molybdenum bar was used as a cathode. 8.5 kg of an electrolyte formulated with the magnesium chloride, the lanthanum praseodymium cerium chloride, and potassium chloride in a mass ratio of 5:40:55 was added into the graphite crucible. Electrolysis was performed under an electrolysis temperature of 850° C., a cathode current density of 20 A/cm$^2$, and a distance between the electrodes of 4 cm; and during the electrolysis, 212 g of lanthanum praseodymium cerium chloride and magnesium chloride having 2 crystalline waters with a mass ratio of 1:1.5 were added at an interval of 5 min. such that a total amount of 7420 g were added. The electrolysis was performed for 3 hrs to obtain 2200 g of the magnesium-lanthanum praseodymium cerium intermediate alloy. The rare earth content was 65%, the current efficiency was 85%, the rare earth direct yield was up to 93%, and the direct yield of magnesium was up to 95%.

Example 3

The raw materials used were: lanthanum praseodymium cerium chloride, which is obtained by subjecting an on-sale crystalline material obtained after neodymium, cerium, and praseodymium had been extracted from common mixed light rare earths (chloride of mixed rare earths, produced by Sichuan Liangyou Rare Earth Ltd., having a lanthanum praseodymium cerium content of 69.4%, and a crystalline water content of 30.6%), to a incomplete dehydrating treatment in a vacuum drying oven under conditions of 85° C., 3 hrs; 130° C., 2 hrs; and 180° C., 1.5 hrs, wherein the lanthanum praseodymium cerium chloride after the incomplete dehydration had a water content of 15 wt %; and a magnesium chloride, which was obtained from $MgCl_2.6H_2O$ after being subjected to a baking process in a drying oven at 110° C. for 7 hrs to remove 4 crystalline waters, and which had a water content of 20 wt % after the baking process.

A graphite crucible was used as an anode, and a molybdenum bar was used as a cathode. 8.5 kg of an electrolyte formulated with the magnesium chloride, the lanthanum praseodymium cerium chloride, and potassium chloride in a mass ratio of 5:40:55 was added into the graphite crucible. Electrolysis was performed under an electrolysis temperature of 850° C., a cathode current density of 10 A/cm$^2$, and a distance between the electrodes of 6 cm; and during the electrolysis, 179.43 g of lanthanum praseodymium cerium chloride and magnesium chloride having 2 crystalline waters with a mass ratio of 1:3.4 were added at an interval of 5 min. such that a total amount of 6280 g were added. The electrolysis was performed for 3 hrs to obtain 1466 g of the magnesium-lanthanum praseodymium cerium intermediate alloy. The rare earth content was 40%, the current efficiency was 76%, the rare earth direct yield was up to 85%, and the direct yield of magnesium was up to 90%.

Example 4

The raw materials used were: lanthanum praseodymium cerium chloride, which is obtained by subjecting an on-sale crystalline material obtained after neodymium, cerium, and praseodymium had been extracted from common mixed light rare earths (chloride of mixed rare earths, produced by Sichuan Liangyou Rare Earth Ltd., having a lanthanum praseodymium cerium content of 69.4%, and a crystalline water content of 30.6%), to a incomplete dehydrating treatment in a vacuum drying oven under conditions of 85° C., 3 hrs; 130° C., 2 hrs; and 180° C., 1 hr, wherein the lanthanum praseodymium cerium chloride after the incomplete dehydration had a water content of 12 wt %; and a magnesium chloride, which was obtained from $MgCl_2.6H_2O$ after being subjected to a baking process in a drying oven at 110° C. for 6 hrs to remove 4 crystalline waters, and which had a water content of 25 wt % after the baking process.

A graphite crucible was used as an anode, and a molybdenum bar was used as a cathode. An electrolyte (the total amount of the electrolyte being 8.5 kg) formulated with the magnesium chloride, the lanthanum praseodymium cerium chloride, and potassium chloride in a mass ratio of 5:35:60 was added into the graphite crucible. Electrolysis was performed under an electrolysis temperature of 800° C., an cathode current density of 20 A/cm2, and a distance between the electrodes of 8 cm; and during the electrolysis, 160 g of lanthanum praseodymium cerium chloride and magnesium chloride having 2 crystalline waters with a mass ratio of 1:3 were added at an interval of 5 min. such that a total amount of 5600 g were added. After 3 hrs lapsed, the magnesium-lanthanum praseodymium cerium intermediate alloy was obtained, which weight was 1380 g. The rare earth content was 45.3%, the current efficiency was 67.5%, the rare earth direct yield was up to 90%, and the direct yield of magnesium was up to 95%.

Example 5

The raw materials used were: lanthanum praseodymium cerium chloride, which is obtained by subjecting an on-sale crystalline material obtained after neodymium, cerium, and praseodymium had been extracted from common mixed light rare earths (chloride of mixed rare earths, produced by Sichuan Liangyou Rare Earth Ltd., having a lanthanum praseodymium cerium content of 69.4%, and a crystalline water content of 30.6%), to a incomplete dehydrating treatment in a vacuum drying oven under conditions of 85° C., 3 hrs; 130° C., 2 hrs; and 180° C., 1.5 hrs, wherein the lanthanum praseodymium cerium chloride after the incomplete dehydration had a water content of 10 wt %; and a magnesium chloride, which was obtained from $MgCl_2.6H_2O$ after being subjected to a baking process in a drying oven at 110° C. for 6 hrs to remove 4 crystalline waters, and which had a water content of 27 wt % after the baking process.

A graphite crucible was used as an anode, and a molybdenum bar was used as a cathode. 8.5 kg of an electrolyte formulated with the magnesium chloride, the lanthanum praseodymium cerium chloride, and potassium chloride in a mass ratio of 5:40:55 was added into the graphite crucible. Electrolysis was performed under an electrolysis temperature of 850° C., a cathode current density of 15 A/cm$^2$, and a distance between the electrodes of 4 cm; and during the electrolysis, 191.14 g of lanthanum praseodymium cerium chloride and magnesium chloride having 2 crystalline waters with a mass ratio of 1:5 were added at an interval of 5 min. such that a total amount of 6690 g were added. The electrolysis was performed for 3 hrs to obtain 1510 g of the magnesium-lanthanum praseodymium cerium intermediate alloy. The rare earth content was 35%, the current efficiency was 82%, the rare earth direct yield was up to 93%, and the direct yield of magnesium was up to 95.7%.

The rare earth content was measured in a chemical analysis by taking the average atomic weight of 140.

The direct yield=the metal amount obtained/the metal amount in the hydrous chlorides added during the electrolysis.

The current efficiency=[(weight of alloy×rare earth content/1.73+weight of alloy×magnesium content/0.453)/1000 A×3 hrs]×100%.

In the above formula, 1.73 is the electrochemical equivalent of the rare earth, 0.453 is the electrochemical equivalent of magnesium, 1000 A is a current strength, and 3 hrs is a time for the electrolysis.

Example 6

The magnesium-lanthanum praseodymium cerium intermediate prepared in Example 2 were added into AZ91 magnesium alloy (produced by Shanxi Yinguang Magnesium Corp.) in ratios shown in Table 1, so as to prepare die-casting alloys, and the tensile strength and the corrosion resistance of the resultant die-casting alloys were measured. The results were shown in Table 1.

TABLE 1

| Alloy | tensile strength (MPa) | percentage elongation (%) |
|---|---|---|
| AZ91 | 207 | 2.5 |
| AZ91 + 0.05 LPC* | 255 | 4.5 |
| AZ91 + 0.1 LPC | 249 | 2.6 |
| AZ91 + 0.3 LPC | 252 | 2.7 |
| AZ91 + 0.5 LPC | 254 | 3.4 |
| | Corrosion speed ($mg/cm^2day$) | |
| AZ91 | 0.208 | |
| AZ91 + 0.2 LPC | 0.045 | |
| AZ91 + 0.5 LPC | 0.009 | |
| AZ91 + 0.8 LPC | 0.067 | |
| AZ91 + 1.2 LPC | 0.015 | |

*LPC represents the magnesium-lanthanum praseodymium cerium intermediate prepared in Example 2.

As shown in Table 1, the addition of the magnesium-lanthanum praseodymium cerium intermediate alloy of the present invention into AZ91 improves the tensile strength and the corrosion resistance of the die-casting alloys.

What is claimed is:

1. A method for producing a magnesium—lanthanum praseodymium cerium intermediate alloy, characterized in that:

the magnesium—lanthanum praseodymium cerium intermediate alloy is obtained by using an incomplete dehydrated lanthanum praseodymium cerium chloride and a magnesium chloride having 2 or less crystalline waters as raw materials, and adding the lanthanum praseodymium cerium chloride and the magnesium chloride in a mass ration of 1: (1.5-5) during an electrolysis performed under the following condition:

a graphite crucible is used as an anode, and a molybdenum bar is used as a cathode; the magnesium chloride, the lanthanum praseodymium cerium chloride, and potassium chloride are added into the graphite crucible such that the mass ratio of the magnesium chloride: the lanthanum praseodymium cerium chloride: potassium chloride is 5: (40-35): (55-60); the electrolysis temperature is 800-900° C., the cathode current density is 10-30 $A/cm^2$, and the distance between the electrodes is 4 to 8 cm.

2. The method for producing a magnesium—lanthanum praseodymium cerium intermediate alloy as claimed in claim 1, characterized in that:

the incomplete dehydrated lanthanum praseodymium cerium chlorides is obtained by subjecting a crystalline material obtained after neodymium, cerium, and praseodymium have been extracted from common mixed light rare earths to a dehydration process so as to have a water content of 10-15wt %.

3. The method for producing a magnesium—lanthanum praseodymium cerium intermediate alloy as claimed in claim 1, characterized in that:

the magnesium chloride having 2 or less crystalline waters is obtained by removing 4 crystalline waters from $MgCl_2.6H_2O$ so as to have a water content of 20-27 wt %.

* * * * *